United States Patent [19]

Oster

[11] Patent Number: 4,948,944

[45] Date of Patent: Aug. 14, 1990

[54] COMPACT HEATER ASSEMBLY FOR A HOT MELT APPLICATOR

[75] Inventor: Craig D. Oster, Oakdale, Minn.

[73] Assignee: Minnesota Mining and Manufacturing Company, St. Paul, Minn.

[21] Appl. No.: 286,653

[22] Filed: Dec. 19, 1988

[51] Int. Cl.[5] ..... H05B 3/00

[52] U.S. Cl. ..... 219/227; 222/146.5

[58] Field of Search ..... 219/227, 228, 229, 230, 219/236–240, 530, 540; 401/1, 2; 222/146.5, 146.2

[56] References Cited

U.S. PATENT DOCUMENTS

| | | | |
|---|---|---|---|
| 3,743,142 | 7/1973 | Elliott et al. | 222/146 HE |
| 3,776,426 | 12/1973 | Newton | 222/146 HE |
| 4,014,464 | 3/1977 | Newton et al. | 222/146 HE |
| 4,059,204 | 11/1977 | Duncan et al. | 222/146 HE |
| 4,493,972 | 1/1985 | Steinel et al. | 219/230 |
| 4,637,745 | 1/1987 | Speisebecher et al. | 401/1 |

*Primary Examiner*—Roy N. Envall, Jr.

*Attorney, Agent, or Firm*—Donald M. Sell; Walter N. Kirn; James D. Christoff

[57] ABSTRACT

A heater assembly for a hot melt applicator includes a heating block having a melting chamber and two compartments receiving a pair of elongated heating elements along opposite sides of the chamber. The heating elements have respective longitudinal axes that lie in a common plane which extends toward an outlet of the melting chamber at an angle relative to a central axis of the melting chamber. In preferred forms, the longitudinal axes of the heating elements converge toward each other as the outlet of the melting chamber is approached.

8 Claims, 3 Drawing Sheets

COMPACT HEATER ASSEMBLY FOR A HOT MELT APPLICATOR

BACKGROUND OF THE INVENTION

1. Field of the Invention

This invention relates to a heater assembly for melting and dispensing hot melt adhesives and similar materials.

2. Description of the Related Art

Hot melt adhesives are widely used for a variety of purposes ranging from industrial to household applications. Often, hot melt adhesives are dispensed by a hand-held applicator which may be conveniently manipulated to deliver molten adhesive directly to an application site. Applicators of this type normally have a heated melting chamber of a truncated cone shape that is adapted to receive and melt elongated blocks of solid thermoplastic adhesive and dispense the molten adhesive through an outlet.

Melting chambers of hot melt applicators are formed within a heating block that is made of metallic materials exhibiting a high thermal conductivity. In some instances, these heating blocks have a cylindrical compartment that is below the melting chamber and which receives a slide-in electrical heating element having an elongated external casing of matching cylindrical shape. Typically, the single heating element of such heater assemblies extends in a direction that is either parallel or somewhat inclined relative to the central longitudinal axis of the truncated conical melting chamber.

Heater assemblies of hot melt applicators are occasionally provided with two or more heating elements in an attempt to increase the available thermal energy and to improve heat distribution to the melting chamber. In some instances, elongated heating elements are located on opposite sides of the melting chamber in an orientation such that the longitudinal axis of each heater and the central axis of the melting chamber all extend in parallel directions in a common plane. However, such construction requires a somewhat bulky heating block which increases the weight of the applicator and hinders observation of the work site.

SUMMARY OF THE INVENTION

The present invention is directed toward a heater assembly for a hot melt applicator which includes a heating block made of a material having a relatively high thermal conductivity and having a melting chamber with an inlet and an outlet. The melting chamber has a generally truncated conical shape tapering toward the outlet along a central reference axis. A pair of elongated heating elements are thermally coupled to the heating block and disposed along opposite sides of the melting chamber. Advantageously, the longitudinal axes of the heating elements generally lie in a common plane that extends toward the outlet at an angle of about 1 degree to about 16 degrees relative to the reference axis.

As such, the configuration of the heater assembly presents a relatively small profile which facilitates observation of the work. In addition, the compact heater assembly is relatively light in weight which reduces the likelihood of operator fatigue that might otherwise occur when the applicator is held in the hand for extended periods The angular orientation of the heating elements relative to the melting chamber also enables the heating elements to efficiently deliver thermal energy to the entire perimeter of the melting chamber.

DESCRIPTION OF THE PREFERRED EMBODIMENT

Figure 1:
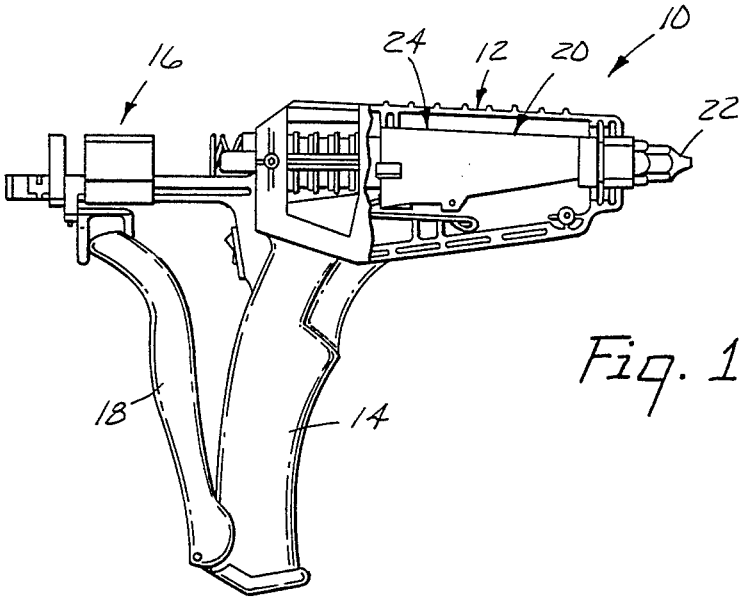
FIG. 1 is a side elevational view of a hot melt adhesive applicator with parts broken away in section to reveal a heater assembly constructed in accordance with the present invention.

A hot melt applicator 10 as illustrated in FIG. 1 includes a housing 12 with a handle 14, along with a feed mechanism 16 adapted to releasably grasp a solid, elongated block of thermoplastic material. The feed mechanism 16 includes an actuator 18 that, when depressed in a direction toward the handle 14, directs the block of material toward a heater assembly 20 which is substantially enclosed within the housing 12. The heater assembly 20 is adapted to receive and melt a forward end portion of the block of material and dispense the molten material through a front nozzle 22 to application site.

Referring now to FIGS. 2–7, the heater assembly 20 includes a unitary heat block 24 that is made from a material exhibiting high thermal conductivity such as aluminum. The heating block 24 has an internal, central melting chamber 26 with an inlet 28 at one end and a somewhat smaller outlet 30 at an opposite end (see, e.g., FIG. 3). The melting chamber 26 has an overall, generally truncated conical shape which tapers toward the outlet 30 along a central reference axis 32. The heating block 24 is also formed with four symmetrically arranged grooves 34 which extend along the melting chamber 26 from the inlet 28 to the outlet 30 and which gradually increase in depth as the outlet 30 is approached.

Figure 2:
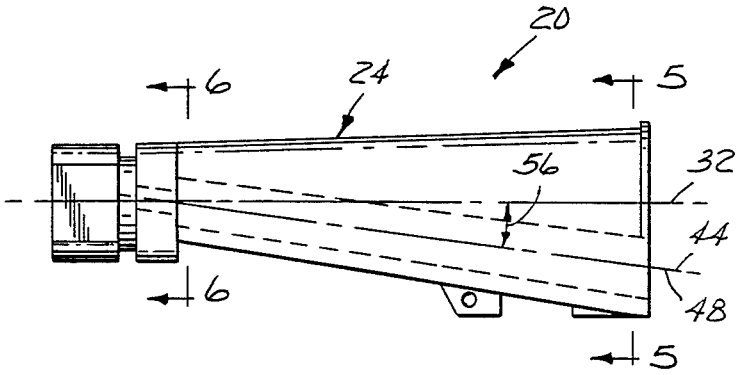
FIG. 2 an enlarged side elevational view of a heat block alone of the heater assembly shown in FIG. 1 taken along an side thereof.
Figure 3:
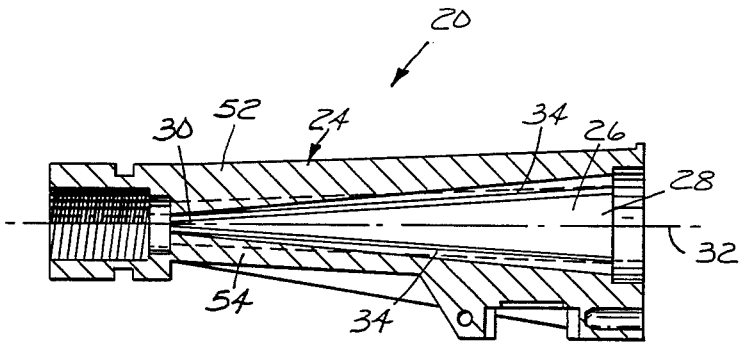
FIG. 3 is a side cross-sectional view of the heat block illustrated in FIG. 2.
Figure 4:
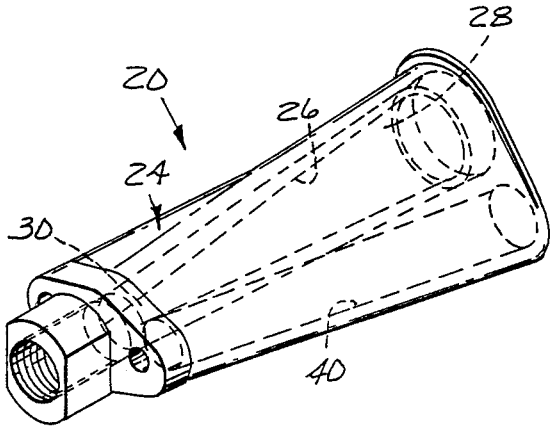
FIG. 4 is a top, front and side perspective view of the heat block shown in FIG. 3.

The heater assembly 20 includes two elongated heating elements 36, 38 (FIG. 7) that are thermally coupled to the heating block 24 and are disposed along opposite sides of the melting chamber 26. The heating elements 36, 38 have an external shape in the form of a truncated cone, and are received in respective, similarly shaped compartments 40, 42 (FIGS. 2 and 4–6) formed in the heating block 24. The heating elements 36, 38 have respective longitudinal axes 44, 46 that generally lie in a common plane which is indicated in FIG. 2 by the numeral 48.

Figure 5:
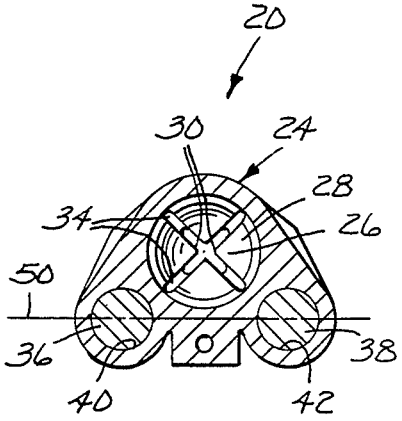
FIG. 5 is a cross-sectional view of the heat block taken along lines 5—5 of FIG. 2.
Figure 7:
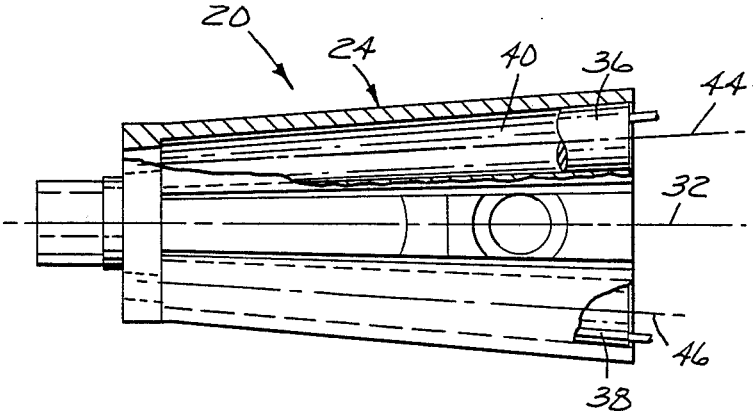
FIG. 7 is a bottom view with parts broken away in section of the heat block shown in FIG. 2 along with a portion of two heating elements of the heater assembly.

In accordance with the invention, the plane 48 containing the axes 44, 46 extends toward the outlet 30 at an angle 56 (see FIG. 2) in the range of about 1 degree to about 16 degrees relative to the central reference axis 32 of the melting chamber 26. Somewhat better results are observed when the angle 56 is in the range of about 3 degrees to about 12 degrees. Moreover, the axes 44, 46 converge toward each other as well as toward the central reference axis 32 as illustrated in FIG. 7 as the outlet 30 is approached. As shown in FIG. 5, a reference line 50 extending between respective rear end portions of the heating elements 36, 38 and along the plane 48 passes outside of the melting chamber 26. Also, an upper wall section 52 (see FIG. 3) of the heating block 24 above the melting chamber 26 is thicker in cross section (in a vertical direction viewing FIG. 3) than an underlying wall section 54 of the heating block 24 below the melting chamber 26.

The angle 56 between the plane 48 and the axis 32 may vary somewhat for optimum results depending upon the desired length of the heating block 24 and the diameter of the solid material to be fed into the melting chamber 26. When, for example, the overall diameter of the solid material is about 0.5 inch (1.27 cm.), the angle 56 should be in the range of about 3 degrees to about 7 degrees. If, on the other hand, the overall diameter of the solid material is about 0.625 inch (1.59 cm.), the angle 56 should be in the range of about 6 degrees to about 10 degrees. For solid material having an overall diameter of about 1.0 inch (2.54 cm.) the angle 56 should be in the range of about 8 degrees to about 12 degrees.

Figure 6:
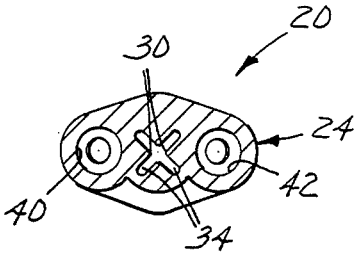
FIG. 6 is a cross-sectional view of the heat block taken along lines 6—6 of FIG. 2.

Construction of the heater assembly 20 in accordance with the foregoing provides efficient heat distribution from the heating elements 36, 38 to the melting chamber 26 around substantially the entire perimeter of the latter. The wall section 52, being thicker than the wall section 54, facilitates the distribution of heat to upper reaches of the melting chamber 26 which are disposed somewhat farther away from the heating elements 36, 38 than underlying regions of the heating block 24 such as wall section 54. Furthermore, the generally overall conical configuration of the heating elements 36, 38 is advantageous in that the forward end profile of the heating block 24 can be reduced even though the forward end portions of the heating elements 36, 38 extend upwardly toward the melting chamber 26 and terminate at respective locations approximately 180 degrees apart relative to the melting chamber 26 as depicted in FIG. 6.

Preferably, electrical resistance wires within the heating elements 36, 38 are constructed or arranged to provide selected quantities of thermal energy per unit length of the elements 36, 38 that vary along the respective lengths of the elements 36, 38. In particular, rear portions of the elements 36, 38 adjacent the rear end portion of the melting chamber 26 near the inlet 28 are constructed to deliver greater heat output (per unit length) than front portions of the elements 36, 38 adjacent the front end portion of the chamber 26 near the outlet 30. This construction facilitates melting the solid adhesive in the rear end portion of the chamber 26 and reduces the likelihood of overheating the molten adhesive during passage through the front end portion of the chamber.

I claim:

1. A heater assembly for a hot melt adhesive applicator comprising:

a heating block made of material having a relatively high thermal conductivity, said heating block having a melting chamber with an inlet and an outlet, said melting chamber having a generally truncated conical shape tapering toward said outlet along a central reference axis; and a pair of elongated spaced apart, electric heating elements thermally coupled to said heating block and disposed along opposite sides of said melting chamber, said heating elements having respective longitudinal axes generally lying in a common plane that extends toward said outlet at an angle in the range of about 1 degree to about 16 degrees relative to said reference axis, wherein said heating elements each have a generally conical external configuration, wherein said heat block has a pair of spaced apart compartments for receiving said elements, each of said compartments having a generally conical shape complemental to said configuration of said heating elements, wherein said heating elements each have a rear end portion which extends along said plane, and wherein a reference line extending between said rear end portions and along said plane passes outside of said melting chamber.

2. The assembly of claim 1, wherein said longitudinal axes of said heating elements converge toward each other as said outlet is approached.

3. The assembly of claim 1, wherein said angle is in the range of about 3 degrees to about 7 degrees.

4. The assembly of claim 1, wherein said angle is in the range of about 6 degrees to about 10 degrees.

5. The assembly of claim 1, wherein said angle is in the range of about 8 degrees to about 12 degrees.

6. The assembly of claim 1, wherein said angle is in the range of about 3 degrees to about 12 degrees.

7. The assembly of claim 1, wherein said heating elements include electrical resistance wires constructed to provide selected quantities of thermal energy per unit length of said elements that varies along the respective lengths of said elements.

8. The assembly of claim 1, wherein said heating elements have forward end portions which terminate at respective locations approximately 180 degrees apart relative to the melting chamber.

* * * * *

UNITED STATES PATENT AND TRADEMARK OFFICE

CERTIFICATE OF CORRECTION

PATENT NO. : 4,948,944

DATED : August 14, 1990

INVENTOR(S) : Craig D. Oster

It is certified that error appears in the above-identified patent and that said Letters Patent is hereby corrected as shown below:

Col. 2, line 9, after the numeral 2 and before "an" insert the the word -- is — .

Col. 2, line 11, after the word "an" insert — opposite — .

Signed and Sealed this

First Day of September, 1992

*Attest:*

DOUGLAS B. COMER

*Attesting Officer*

*Acting Commissioner of Patents and Trademarks*